US006615980B2

(12) United States Patent
Draghetti et al.

(10) Patent No.: US 6,615,980 B2
(45) Date of Patent: Sep. 9, 2003

(54) PACKET OF CIGARETTES AND RELATIVE MANUFACTURING METHOD

(75) Inventors: Fiorenzo Draghetti, Medicina (IT); Eros Stivani, Bologna (IT)

(73) Assignee: G. D. Societa' per Azioni, Bologna (IT)

( * ) Notice: Subject to any disclaimer, the term of this patent is extended or adjusted under 35 U.S.C. 154(b) by 0 days.

(21) Appl. No.: 10/197,194

(22) Filed: Jul. 17, 2002

(65) Prior Publication Data

US 2003/0047469 A1 Mar. 13, 2003

Related U.S. Application Data

(63) Continuation of application No. PCT/IT01/00024, filed on Jan. 18, 2001.

(30) Foreign Application Priority Data

Jan. 18, 2000 (IT) ..... BO2000A 000010

(51) Int. Cl.[7] ..... B65D 85/10; B65B 19/00

(52) U.S. Cl. ..... 206/245; 53/415; 206/271; 206/459.5

(58) Field of Search ..... 53/415; 206/242, 206/245, 268, 271, 273, 459.1, 459.5; 340/572.6

(56) References Cited

U.S. PATENT DOCUMENTS

| | | | | |
|---|---|---|---|---|
| 4,651,877 A | * | 3/1987 | Adrianus de Mooy | 206/459.5 |
| 4,836,378 A | * | 6/1989 | Lephardt | 206/459.5 |
| 5,931,292 A | | 8/1999 | Focke et al. | |
| 6,209,290 B1 | * | 4/2001 | Boriani et al. | 53/415 |
| 6,216,860 B1 | * | 4/2001 | Boriani et al. | 206/268 |
| 2003/0038044 A1 | * | 2/2003 | Draghetti | 206/273 |
| 2003/0052020 A1 | * | 3/2003 | Draghetti et al. | 206/245 |

FOREIGN PATENT DOCUMENTS

| | | |
|---|---|---|
| EP | 0 317 202 | 5/1989 |
| EP | 0 960 831 | 12/1999 |
| EP | 0 967 161 | 12/1999 |

* cited by examiner

*Primary Examiner*—Jim Foster
(74) *Attorney, Agent, or Firm*—Marshall, Gerstein & Borun

(57) ABSTRACT

The packet (1) of cigarettes, wherein an outer wrapping (2) of cardboard or similar is covered with an overwrapping (3) of transparent material to which is integrally connected a portion (12) of magnetic tape (24) for recording data.

15 Claims, 3 Drawing Sheets

PACKET OF CIGARETTES AND RELATIVE MANUFACTURING METHOD

CROSS REFERENCE TO RELATED APPLICATIONS

This is a continuation of international application PCT/IT01/00024, filed Jan. 18, 2001.

TECHNICAL FIELD

The present invention relates to a packet of cigarettes.

More specifically, the present invention relates to a parallelepiped-shaped packet of cigarettes comprising an outer wrapping—normally formed from a folded sheet or from a cardboard blank with preformed bend lines—and an inner wrapping of foil or paper wrapped about a group of cigarettes. If the outer wrapping is made of cardboard or similar, the packet normally also comprises a cardboard collar interposed between the inner and outer wrapping.

BACKGROUND ART

Patent EP 317202 describes a packet of the above type, which comprises a portion of magnetic tape visible from the outside and for recording data unequivocally identifying the packet. In other words, for each packet, the portion of magnetic tape constitutes a certificate of origin making counterfeiting of the packet extremely complicated and expensive.

According to Patent EP 317202, the portion of magnetic tape is connected to any point on the outer wrapping of the packet, before the overwrapping is applied.

The above method poses several drawbacks, mainly due to the portion of magnetic tape being applied to the packet before the packet comes off the packaging machine, i.e. before the packet is subjected to various mechanical and thermal stress along a drying portion of the packaging machine, inside compensating stores interposed between the packaging machine and a follow-up cellophaning machine, and inside the cellophaning machine itself. Which mechanical and thermal stress may result in detachment of the tape and/or at least partial deletion of the magnetic data recorded on the tape.

DISCLOSURE OF INVENTION

It is an object of the present invention to provide a packet of cigarettes comprising a portion of magnetic tape for recording data, but designed to eliminate the aforementioned drawbacks.

According to the present invention, there is provided a packet of cigarettes comprising an outer wrapping; an overwrapping of transparent material covering said outer wrapping; and a portion of magnetic tape for recording data; characterized in that said portion of magnetic tape is connected integrally to said overwrapping.

The present invention also relates to a method of manufacturing the packet of cigarettes defined above.

According to the present invention, there is provided a method of manufacturing a packet of cigarettes comprising an outer wrapping, an overwrapping of transparent material covering said outer wrapping, and a portion of magnetic tape for recording data; the method being characterized by feeding said portion of magnetic tape onto said overwrapping, and fixing the portion of magnetic tape irremovably to said overwrapping.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 2:
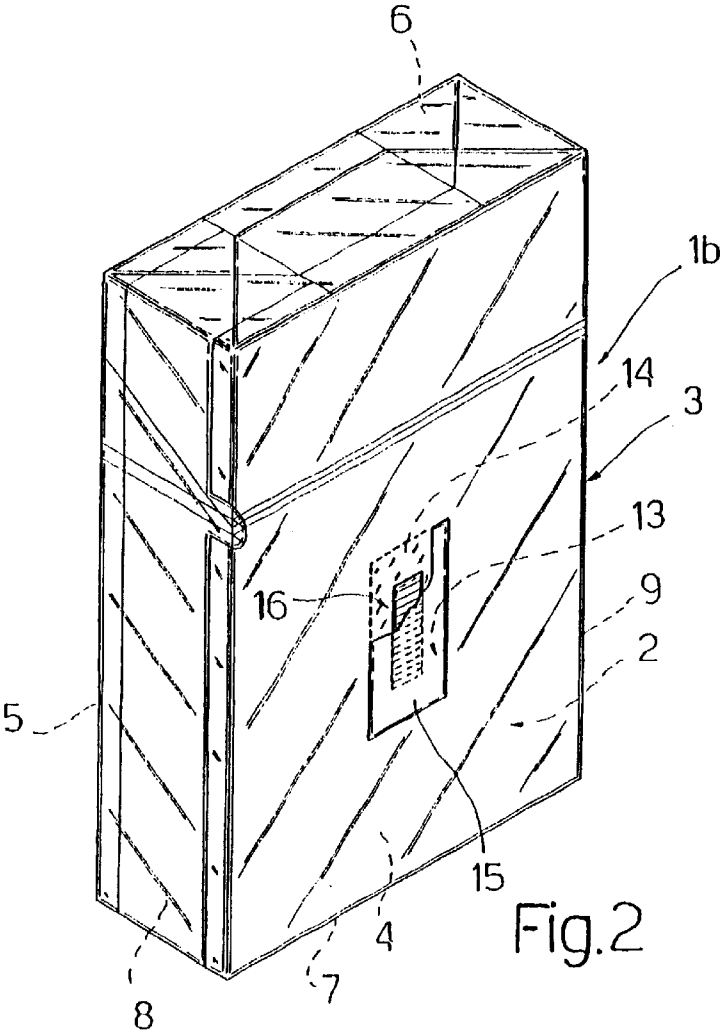
FIG. 2 shows a view in perspective, with a part removed for clarity, of a second preferred embodiment of the packet according to the present invention.
Figure 1:
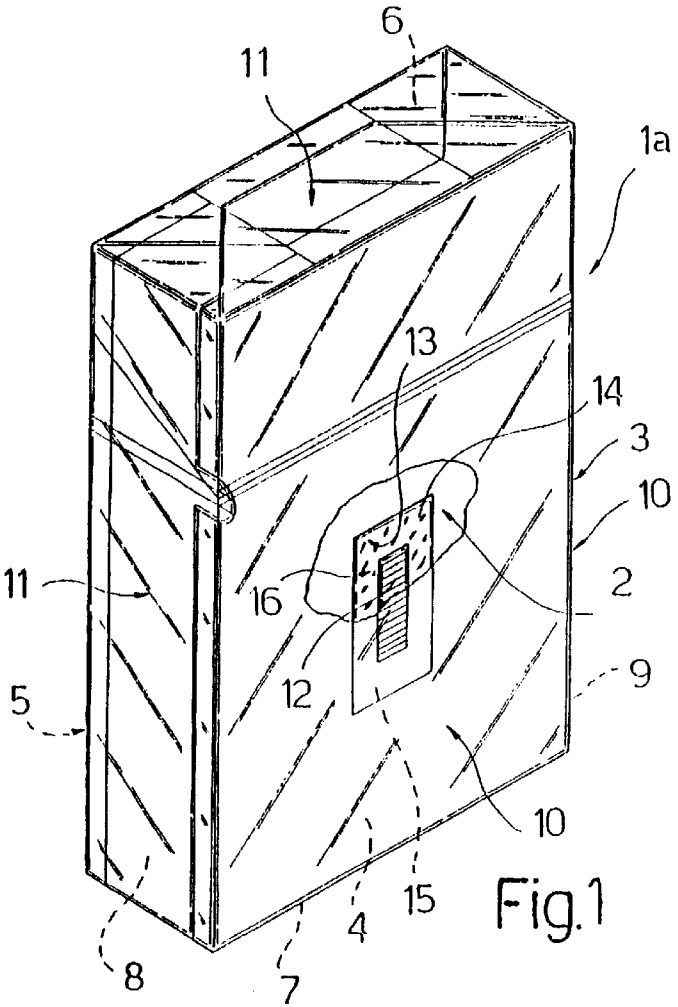
FIG. 1 shows a view in perspective, with a part removed for clarity, of a first preferred embodiment of the packet according to the present invention.

With reference to FIGS. 1 and 2, number 1 indicates as a whole a packet—indicated 1*a* in FIG. 1 and 1*b* in FIG. 2—for housing a group of cigarettes (not shown) and comprising a substantially parallelepiped-shaped outer wrapping 2 covered with an overwrapping 3 of transparent material—in the example shown, polypropylene.

Wrapping 2 comprises a large front wall 4; a large rear wall 5 parallel to front wall 4; a top wall 6; a bottom wall 7 parallel to top wall 6; and two small lateral walls 8 and 9 parallel to each other and perpendicular to walls 4 and 5.

Wrapping 2 is covered with overwrapping 3, which comprises a "single-layer" portion 10 over walls 4, 5 and 9; and a "multilayer" portion 11 over walls 6, 7 and 8, and wherein at least two superimposed layers of transparent material are heat sealed to each other.

With reference to FIGS. 1 and 2, portion 10 of overwrapping 3 is fitted with a portion 12 of magnetic tape, which, when magnetized, provides for recording a predetermined code containing given information.

Portion 12 is substantially rectangular, and is fixed to a central portion of a surface 13—cold coated with a layer 14 of gum—of a portion 15 of preferably transparent sheet material. Portion 15 is wider and longer than portion 12, so as to be connectable to portion 10 of overwrapping 3 by the peripheral portion of surface 13 projecting outwards of portion 12. Once connected by surface 13 to the inner surface of overwrapping 3, as in the FIG. 1 packet 1*a*, or to the outer surface of overwrapping 3, as in the FIG. 2 packet 1*b*, portion 15 therefore defines a closed pocket 16 housing respective portion 12 in a fixed predetermined position.

Figure 3:
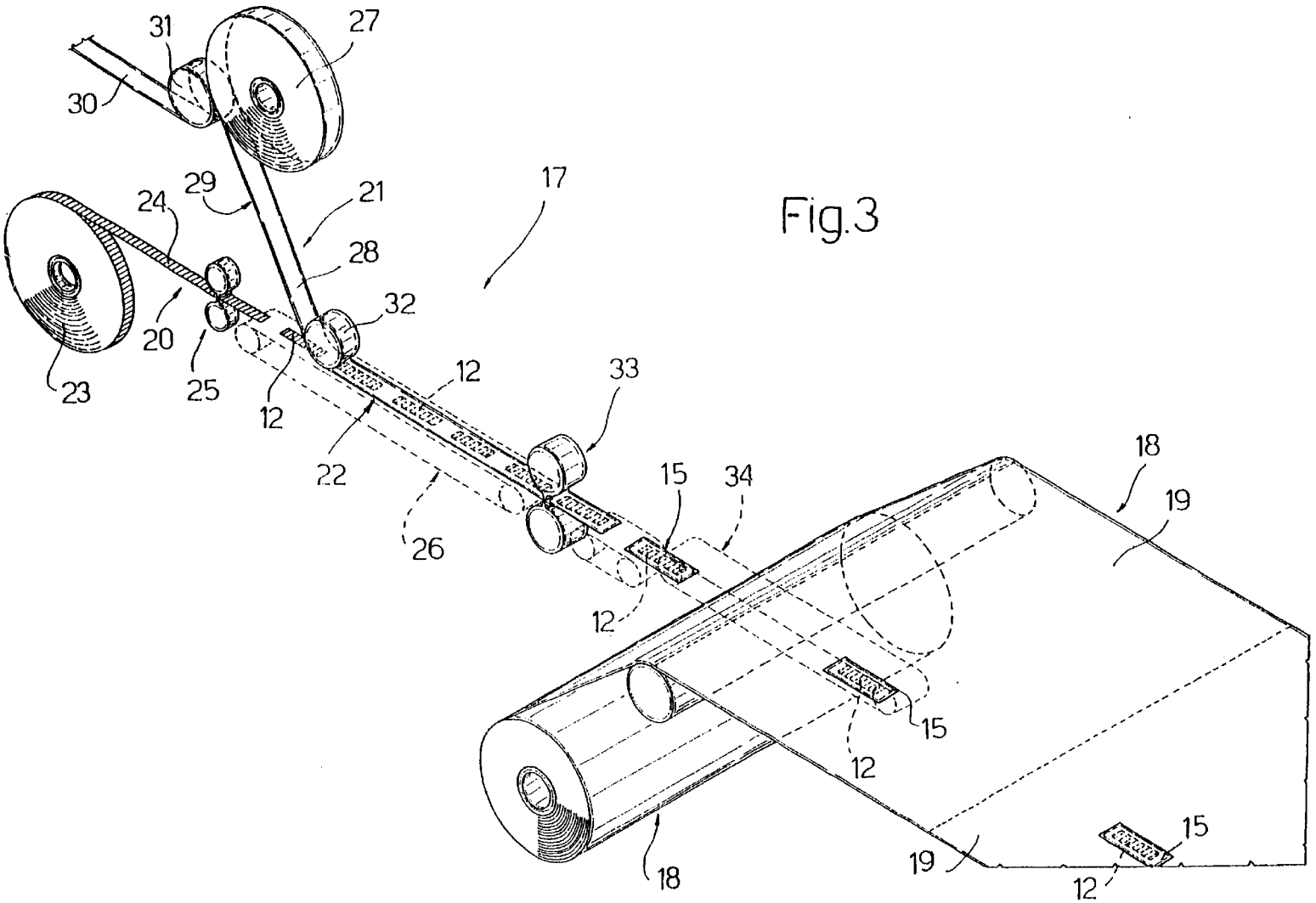
FIG. 3 shows a schematic view in perspective of a portion of a production line of a manufacturing machine for producing the FIG. 1 or FIG. 2 packet.

As shown in FIG. 3, pockets 16 with enclosed portions 12 are formed, on a cellophaning machine 17, on a continuous strip 18 of overwrapping material, before strip 18 is cut into sheets 19, each defining a respective overwrapping 3. For which purpose, cellophaning machine 17 comprises a line 20 for supplying portions 12, and a line 21 for supplying portions 15, which lines 20 and 21 converge at a line 22 for supplying strip 18.

More specifically, line 20 comprises a reel 23, from which is unwound a continuous tape 24 of magnetizable material, which is cut into a succession of portions 12 at a cutting station 25. Portions 12 so formed are fed onto a conveyor 26, preferably a nonstick suction conveyor, by which they are accelerated and equally spaced with a spacing equal to the length of portions 15.

Line 21 comprises a reel 27, from which is unwound a continuous strip 28 of transparent material, a cold-gummed surface 29 of which is protected by a nonstick strip 30, which is unwound together with strip 28 and guided by a guide roller 31 along a takeup path. Continuous strip 28 is guided by a guide roller 32 onto conveyor 26 so that surface 29 adheres to portions 12 equally spaced along conveyor 26. Together with portions 12 adhering to it, strip 28 is fed by conveyor 26 through a cutting station 33, where strip 28 is cut into a succession of portions 15 at intermediate points of the portions of strip 28 between adjacent portions 12. Portions 15 and respective portions 12 are fed by conveyor 26 onto a further conveyor 34, by which they are accelerated and spaced apart by a distance equal to the length of a sheet 19 before being applied to strip 18 in the desired position and one for each sheet 19 obviously, the sheets 19 obtained will be so folded that portions 15 are located on the inside or outside, depending on whether packet 1*a* or packet 1*b* is to be formed.

Figure 4:
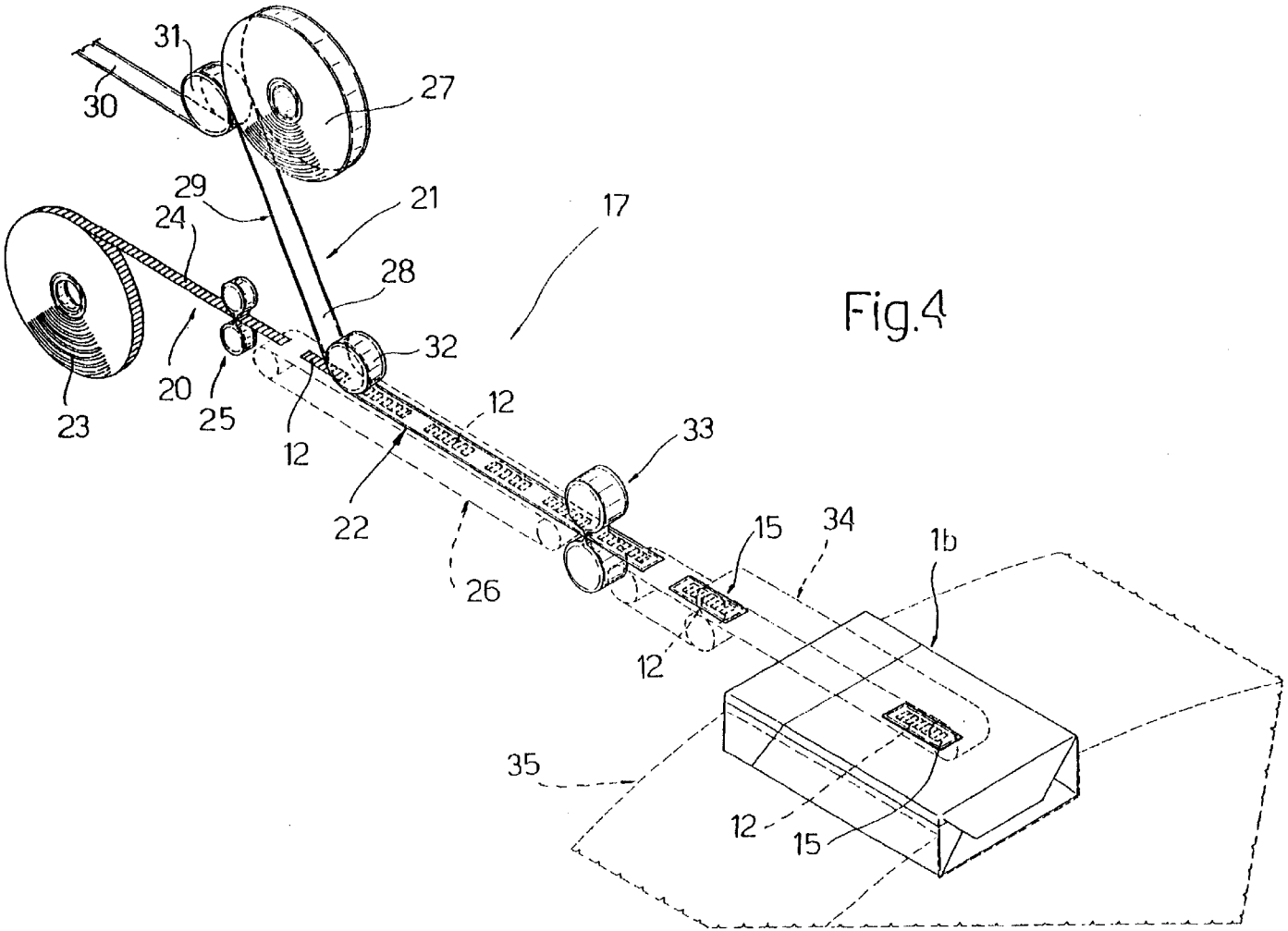
FIG. 4 shows a schematic view in perspective of a portion of a production line of a manufacturing machine for producing the FIG. 2 packet.

In the FIG. 4 variation relative to packet 1*b* only, line 20 supplying portions 12 and line 21 supplying portions 15 converge, via conveyor 34, at a line 35 for supplying packets 1 already provided with overwrappings 3, onto the outer surface of each of which a respective portion 15 is fed directly with respective gummed surface 13 facing the outer surface of overwrapping 3.

Obviously, in the case of packets 1*a*, since sheets 19 are folded and sealed after portions 15 and respective portions 12 are applied, portions 15 are preferably applied to respective sheets 19 so as to be located on single-layer portions 10 of respective overwrappings 3. Conversely, in the case of packets 1*b*, since sheets 19 are folded and sealed before portions 15 and respective portions 12 are applied, portions 15 may be applied indifferently to single-layer portions 10 or multilayer portions 11 of respective overwrappings 3.

According to a variation (nor shown) of the present invention, and as will be obvious from the foregoing description, portions 12 may be connected directly to overwrappings 3 of transparent material, before or after overwrappings 3 are cut off strip 18.

What is claimed is:

1. A packet of cigarettes comprising an outer wrapping (2), an overwrapping (3) of transparent material covering said outer wrapping (2), and a portion (12) of magnetic tape (24) for recording data and connected integrally to said overwrapping (3); the packet being characterized by comprising a pocket (16) formed on said overwrapping (3) and housing said portion (12) of magnetic tape (24).

2. The packet as claimed in claim 1, further comprising a first portion (12) of strip material defining said portion (12) of magnetic tape (24); and a second portion (15) of strip material larger in size than said first portion (12) and having a surface (13) connected integrally to said overwrapping (3), with the interposition of said first portion (12), to form said pocket (16).

3. The packet as claimed in claim 1 or 2, wherein said portion (12) of magnetic tape (24) is connected to a surface of said overwrapping (3) facing said outer wrapping (2).

4. The packet as claimed in claim 3, wherein said overwrapping (3) comprises a single-layer portion (10); and a multilayer portion (11) wherein at least two superimposed layers are heat sealed to each other; said portion (12) of magnetic tape (24) being connected to said single-layer portion (10).

5. The packet as claimed in claim 4, wherein said portion (12) of magnetic tape (24) is connected to an outer surface of said overwrapping (3).

6. The packet as claimed in claim 5, wherein said overwrapping (3) comprises a single-layer portion (10); and a multilayer portion (11) wherein at least two superimposed layers are heat sealed to each other; said portion (12) of magnetic tape (24) being connected to said single-layer portion (10).

7. A method of manufacturing a packet of cigarettes comprising an outer wrapping (2), an overwrapping (3) of transparent material covering said outer wrapping (2), and a portion (12) of magnetic tape (24) for recording data; the method comprising feeding said portion (12) of magnetic tape (24) onto said overwrapping (3), and fixing the portion (12) of magnetic tape (24) irremovably to said overwrapping (3); the method being characterized by forming a pocket (16) on said overwrapping (3) to house said portion (12) of magnetic tape (24).

8. The method as claimed in claim 7 and comprising steps of feeding, with a first given spacing, a first succession of first portions (12) of strip material defining said portions (12) of magnetic tape (24); feeding a continuous strip (28) onto said first portions (12) in said first succession, said continuous strip (28) having a cold-gummed surface (29) which is caused to adhere to said first portions (12); cutting said continuous strip (28) between each pair of adjacent said first portions (12) to obtain a second succession of second portions (15), each having a respective first portion (12); and connecting each said second portion (15) to a respective said overwrapping (3) to form a respective said pocket (16).

9. The method as claimed in claim 7 or 8, wherein said portion (12) of magnetic tape (24) is connected to a surface of said overwrapping (3) facing said outer wrapping (2).

10. The method as claimed in claim 9, wherein said overwrapping (3) comprises a single-layer portion (10); and multilayer portion (11) wherein at least two superimposed layers are heat sealed to each other; said portion (12) of magnetic tape (24) being connected to said single-layer portion (10).

11. The method as claimed in claim 9, wherein said overwrapping (3) is formed by folding a sheet (19) of transparent material about said outer wrapping (2); said portion (12) of magnetic tape (24) being connected to said sheet (19) before the sheet is folded about said outer wrapping (2).

12. The method as claimed in claim 7 or 8, wherein said portion (12) of magnetic tape (24) is connected to an outer surface of said overwrapping (3).

13. The method as claimed in claim 12, wherein said overwrapping (3) comprises a single-layer portion (10); and a multilayer portion (11) wherein at least two superimposed layers are heat sealed to each other; said portion (12) of magnetic tape (24) being connected to said single-layer portion (10).

14. The method as claimed in claim 12, wherein said overwrapping (3) is formed by folding a sheet (19) of transparent material about said outer wrapping (2); said portion (12) of magnetic tape (24) being connected to said sheet (19) before the sheet is folded about said outer wrapping (2).

15. The method as claimed in claim 12, wherein said overwrapping (3) is formed by folding a sheet (19) of transparent material about said outer wrapping (2); said portion (12) of magnetic tape (24) being connected to said sheet (19) before the sheet is folded about said outer wrapping (2).

* * * * *

UNITED STATES PATENT AND TRADEMARK OFFICE

CERTIFICATE OF CORRECTION

PATENT NO. : 6,615,980 B2 
DATED : September 9, 2003
INVENTOR(S) : Fiorenzo Draghetti et al.

It is certified that error appears in the above-identified patent and that said Letters Patent is hereby corrected as shown below:

Title page,
Item [73], Assignee, "G. D. Societa' per Azioni" should be -- G.D Societa' per Azioni --

Signed and Sealed this

Seventeenth Day of February, 2004

JON W. DUDAS
*Acting Director of the United States Patent and Trademark Office*